US010167157B2

(12) United States Patent
Schreiber et al.

(10) Patent No.: US 10,167,157 B2
(45) Date of Patent: Jan. 1, 2019

(54) STATION FOR INSPECTING ROLLED STRIPS IN COILS

(71) Applicant: Danieli & C. Officine Meccaniche S.P.A., Buttrio (IT)

(72) Inventors: Marco Schreiber, Brescia (IT); Luca Bressan, Possuolo D.f. (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 232 days.

(21) Appl. No.: 15/113,195

(22) PCT Filed: Jan. 27, 2015

(86) PCT No.: PCT/IB2015/050607

§ 371 (c)(1),
(2) Date: Jul. 21, 2016

(87) PCT Pub. No.: WO2015/111028

PCT Pub. Date: Jul. 30, 2015

(65) Prior Publication Data

US 2017/0001824 A1 Jan. 5, 2017

(30) Foreign Application Priority Data

Jan. 27, 2015 (IT) ..... MI2014A0104

(51) Int. Cl.
*B21C 47/18* (2006.01)
*B65H 20/36* (2006.01)
(Continued)

(52) U.S. Cl.
CPC ..... *B65H 20/36* (2013.01); *B21C 47/18* (2013.01); *B21C 47/3433* (2013.01);
(Continued)

(58) Field of Classification Search
CPC .. B65H 20/36; B65H 16/106; B65H 35/0006; B21C 47/18; B21C 47/3433
See application file for complete search history.

(56) References Cited

U.S. PATENT DOCUMENTS 3,343,762 A 9/1967 Ungerer
3,635,417 A * 1/1972 Kajiwara ..... B21C 47/16 242/559.4

(Continued)

FOREIGN PATENT DOCUMENTS

CN 101084076 12/2007
FR 2898861 9/2007

(Continued)

*Primary Examiner* — Sang K Kim
(74) *Attorney, Agent, or Firm* — Stetina Brunda Garred & Brucker

(57) ABSTRACT

A station (100, 110) for inspecting rolled strips wound in coils, comprises: —a first pair of mutually opposed pinch rolls (3, 4), adapted to receive and feed a rolled strip (1) from a coil (10); —a carriage (7) sliding between a first start position, near said first pair of pinch rolls (3, 4), and a second end position, said sliding carriage (1) comprising a gripping member to grasp said rolled strip (1) coming from said first pair of pinch rolls (3, 4), said carriage allowing the strip to be unwound without contact with a surface (S1) to be inspected.

18 Claims, 2 Drawing Sheets

(51) Int. Cl.

| | |
|---|---|
| ***B21C 47/34*** | (2006.01) |
| ***B65H 16/10*** | (2006.01) |
| ***B65H 35/00*** | (2006.01) |

(52) U.S. Cl.
CPC ..... *B65H 16/106* (2013.01); *B65H 35/0006* (2013.01); *B65H 2701/173* (2013.01); *B65H 2701/1732* (2013.01)

(56) References Cited

U.S. PATENT DOCUMENTS

| | | | | |
|---|---|---|---|---|
| 3,834,204 | A * | 9/1974 | Ihle | B21C 47/18 72/183 |
| 4,214,467 | A | 7/1980 | Sankaran | |

FOREIGN PATENT DOCUMENTS

| | | |
|---|---|---|
| JP | S59169620 | 9/1984 |
| JP | 622557 | 1/1987 |
| JP | H06238334 | 8/1994 |
| JP | H06297035 | 10/1994 |
| JP | H1128511 | 2/1999 |
| JP | 2006110552 | 4/2006 |
| KR | 20080023258 | 3/2008 |
| WO | WO201213661 | 9/2012 |

* cited by examiner

STATION FOR INSPECTING ROLLED STRIPS IN COILS

CROSS REVERENCE TO RELATED APPLICATIONS

The present application claims priority to PCT International Application No PCT/IB2015/050607 filed on Jan. 27, 2015, which application claims priority to Italian Patent Application No. MI2014A000104 filed Jan. 27, 2014, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention relates to a station for inspecting rolled strips made of aluminum, steel or metal alloys generally wound in coils.

BACKGROUND ART

It is common practice to inspect rolled strips to evaluate the state of wear of the rolling cylinders in the technical rolling field. The possible need to change the rolling cylinders is determined according to the quality of the strip, i.e. according to the number, extent and degree of acceptability of the faults detected thereon.

In order to evaluate the quality of a rolled strip wound in a oil it is also required to evaluate the surface quality of the inner coil face, i.e. the concave face facing the winding axis of the coil, even at the innermost turns. This is only possible by unwinding the coil.

To this end, inspection stations which form an off-line apparatus can be used, even to perform mechanical measurements, such as for example thickness or hardness measurements, on strip samples. The main problem which influences the design and construction of such inspection stations is represented by the very thick wound strips or those with high yield strength tending to maintain the curved shape (the so-called "coil set") also after the unwinding. Straightening the strip, e.g. by means of further mechanical members, such as rolls or tables, is thus required in order to facilitate the inspection operations. However, to preserve the strip quality without modifying the mechanical surface features of the zone to be inspected, the contact between the strip and the mechanical members (rolls, tables, etc.) used to straighten it should be limited as much as possible.

For this reason, it is known to provide at least two different types of inspection stations, which can be used exclusively for strips of small maximum thicknesses, e.g. up to a maximum thickness of about 2 mm, or for thicker strips, e.g. thicker than 2 mm, respectively.

SUMMARY OF TELE INVENTION

Therefore, it is the main object of the present invention to provide a station for inspecting coils of either thin or thick rolled strips made of metal (ferrous or non-ferrous) material, thus comprising an overall thickness range from 0.1 and 25 mm, so that the strip can be stretched and inspected, thus avoiding the coil set problem.

Such an object is achieved by means of a station for inspecting rolled strips wound in coils comprising:

a first pair of mutually opposed pinch rolls, adapted to receive a rolled strip from a coil, a carriage sliding between a first start position, near said first pair of pinch rolls, and a second end position, said sliding carriage comprising a gripping member to grasp said rolled strip coming from said first pair of pinch rolls.

The inspection station according to the present invention allows the contact between the strip surface to be inspected and other objects to be limited exclusively to an end portion of the strip itself, which in all cases is not subject to the inspection, while the inner surface of the strip which passes in the inspection zone does not come into contact with any mechanical member, and thus does not undergo any deterioration with respect to the strip wound on the coil.

The possibility of adjusting the distance between the pinch roll pairs and to size the gripping member of the sliding carriage appropriately allows to process strips in a wide range of thickness.

BRIEF DESCRIPTION OF THE DRAWINGS

Further features and advantages of the present invention will become more apparent from the detailed description of preferred, but not exclusive, embodiments of a station for inspecting rolled strip coils according to the present invention, shown by way of non-limitative example, with the aid of the accompanying drawings, in which.

DETAILED DESCRIPTION OF THE INVENTION

Figure 1:
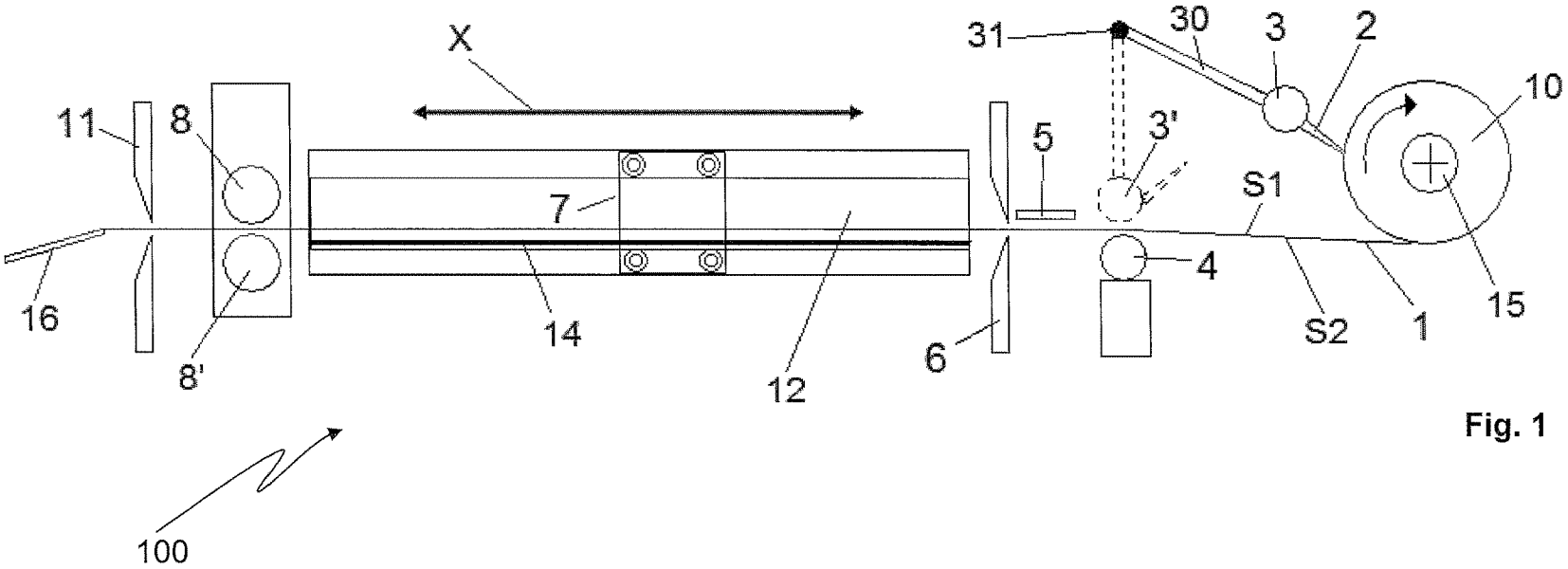
FIG. 1 is a diagrammatic side view of a first embodiment of a station for inspecting rolled strip coils according to the present invention.

With reference to the accompanying drawings, in a first embodiment (FIGS. 1 and 2) a station 100 for inspecting rolled strip coils comprises a mandrel 15, on which a strip 1 can be mounted being wound in a coil 10. Alternatively, according to a second and a third embodiment (FIGS. 3 and 4), a station 110 for inspecting rolled strip coils comprises a blocker roll system 13 adapted to accommodate the coil 10 to be unwound. For the purposes of the present invention, the two embodiments in the accompanying drawings are mutually equivalent, and therefore reference will be made hereinafter to either one or the other unless otherwise indicated. In the various figures, the same reference numerals thus indicate equivalent or similar elements.

An inner surface S1 and an outer surface S2 are defined on strip 1, corresponding to the surfaces which take a concave and a convex shape in coil 10, respectively. The inner surface S1 is that normally subject to inspection.

In operation, coil 10 is rotated according to a predetermined rotation direction (clockwise in the embodiments shown in the accompanying drawings), so as to unwind strip 1 starting from a free end 1*a* thereof. Station 100, 110 comprises a first pair of pinch rolls 3, 4 (upper and lower pinch roll, respectively), between which the free end 1*a* of strip 1 is susceptible of being grasped with the inner surface S1 facing the upper roll 3 and the outer surface S2 facing the lower roll 4.

The pinch rolls 3, 4 are advantageously made of rubber so as to limit the damages that they can cause on both surfaces S1, S2 of strip 1.

The pinch rolls 3, 4 are motorized to be both rotated about the axis thereof. According to another embodiment, only one of the pinch rolls 3, 4 is motorized to be rotated about the axis thereof.

Figure 2:
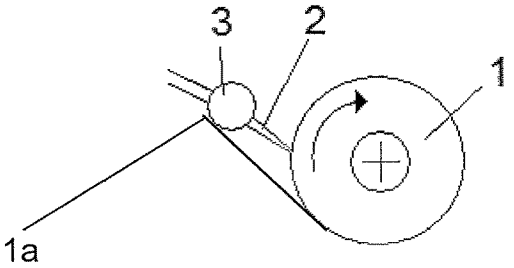
FIG. 2 is a side view of a detail of the station in FIG. 1, in a specific operating condition.
Figure 4:
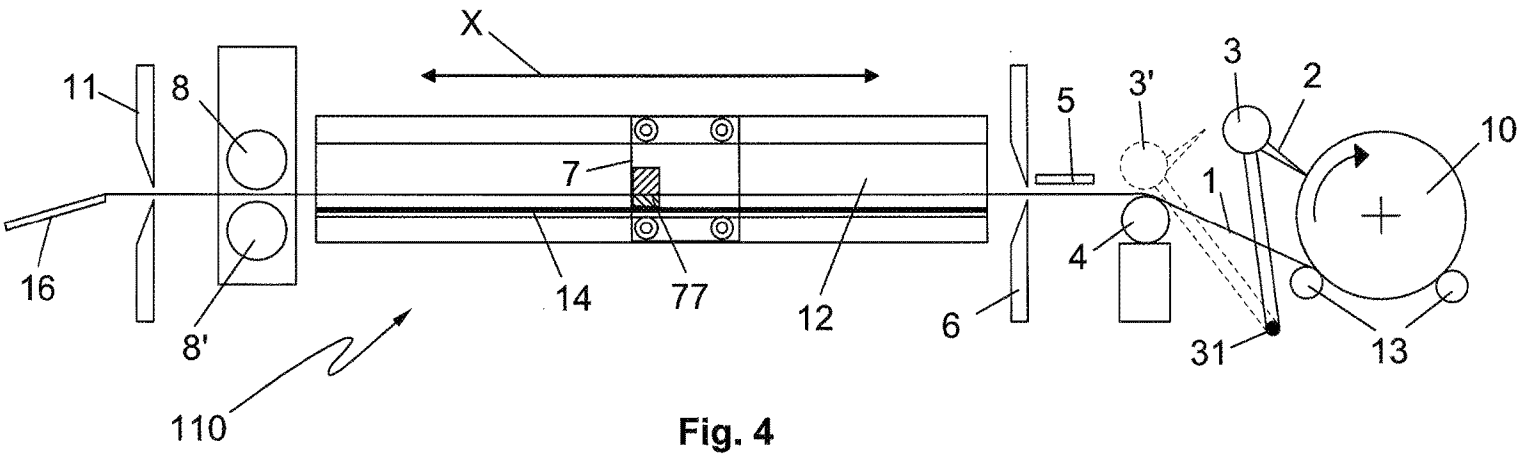
FIG. 4 is a diagrammatic side view of a third embodiment of a station for inspecting roiled strip coils according to the present invention.

In the embodiments in FIGS. 1, 2 and 4, the upper pinch roll 3 is mounted on an arm 30 swinging about a pin 31 and provided with a board 2 in order to facilitate the grasping of the free end 1*a* of strip 1 by the pinch rolls 3, 4. The upper pinch roll 3 is placed, in use, in an initial raised position near coil 10 at the beginning of the unwinding rotation of coil 10 by mandrel 15. In the raised position, board 2 intercepts the free end 1*a* of strip 1, detaching it from the body of coil 10. The free end 1*a* of strip 1 runs on board 2, moving away from coil 10, until it reaches the upper pinch roll 3 (FIG. 2). Mandrel 15 continues to rotate, further unwinding strip 1, which would tend to rewind itself on coil 10, particularly in the case of high coil set, i.e. for thick strips or strips with high yield strength. However, the upper pinch roll 3 is an obstacle to the tendency of strip 1 to rewind back on coil 10. After the free end 1*a* has been intercepted by the upper pinch roll 3 this is thus rotated about pin 31 by means of the swinging arm 30 until it reaches a lowered end position (dashed position 3' in FIG. 1) in which the pinch rolls 3, 4 face each other. In order to facilitate the gripping of strip 1, the lower pinch roll 4 is mounted on a translating member 24 adapted to move the lower pinch roll 4 towards the upper pinch roll 3 when the latter reaches the end position 3'.

In the embodiment in FIGS. 1, 2, with respect to strip 1, the swinging arm 30 is mounted and swings on the side of the inner surface S1.

Alternatively, according to the embodiment in FIG. 4, pin 31 is placed on the side of the outer face S2 and the swinging arm 30 extends beyond strip 1, so as to take the upper pinch roll 3 into contact with the inner surface S1.

Figure 3:
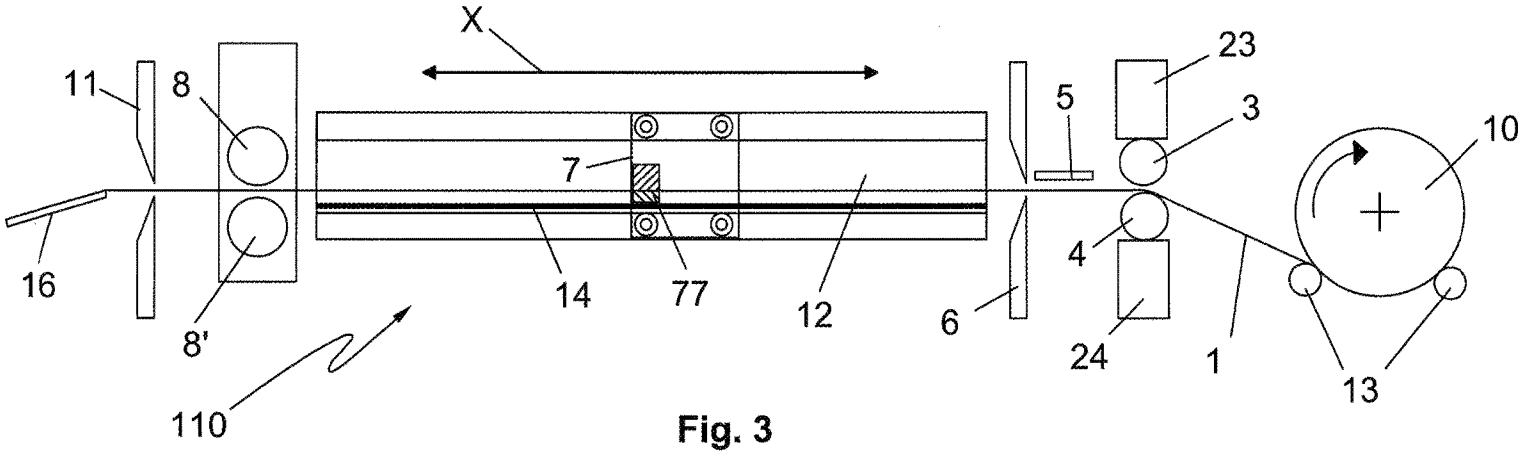
FIG. 3 is a diagrammatic side view of a second embodiment of a station for inspecting rolled strip coils according to the present invention.

In the embodiment in FIG. 3, at least one of the pinch rolls 3, 4 is mounted on a respective translating member 23, 24 to move the pinch rolls 3, 4 mutually away or towards each other along a direction orthogonal to the rotation axis of the pinch rolls 3, 4. This allows to facilitate the grasping of the free end 1*a* of the strip 1 coming from coil 10.

Downstream of the pinch rolls 3, 4, station 100, 110 comprises first shears 6 for cutting strip 1 under the operating conditions illustrated in greater detail below. In an intermediate position between shears 6 and the pinch rolls 3, 4, it is optionally provided with a fixed board 5 placed over strip 1 to contrast the tendency to maintain the wound shape, which is particularly significant for thicker strips or strips with higher yield strength.

Downstream of shears 6, station 100, 110 comprises a carriage 7 translating along a plurality of guides 12 arranged according to a feeding direction X, normally, but not necessarily, coinciding with the horizontal direction. In use, at the beginning of the step of unwinding coil 10, carriage 7 is arranged in the start position, closest to the pinch rolls 3, 4. Due to the action of mandrel 15 or of the roll unwinding system 13 and of the pair of pinch rolls 3, 4, strip 1 crosses carriage 7 passing through a metal strip gripping member 77, known per se and conventional, and therefore not described in greater detail. The gripping member 77 is activated to block strip 1 with respect to carriage 7 after the free end 1*a* has crossed the gripping member 77 of carriage 7. The end portion of strip 1 which is held is normally of limited length and is normally not subject to inspection. The pinch rolls 3, 4 are then spaced apart from the strip and carriage 7 translates along the guides 12 towards the end position furthermost from the pinch rolls 3, 4. Carriage 7 translates along the guides 12 at the same unwinding speed as coil 10, set either by mandrel 15 or by the roll unwinding system 13, so as to keep strip 1 taut thus limiting the coil set.

A movable mat 14 in contact with the outer surface S2 is optionally provided over the whole travel extension of carriage 7, along the guides 12, on the side of carriage 7 corresponding to the outer surface S2. The movable mat 14 provides a base surface for the sliding movement of the strip, while avoiding any friction between such a base surface and the outer surface S2.

Station 100, 110 comprises a second pair of pinch rolls 8, 8' close to the end position of carriage 7, downstream with respect to the feeding direction X. Second shears 11 are provided downstream of the second pair of pinch rolls 8, 8'.

If the part of the strip 1 to be inspected is the initial part, comprising the free end 1*a*, once carriage 7 has reached the end position, it remains there cooperating with the pinch rolls 3, 4 or with mandrel 15 to maintain strip 1 taut, thus allowing to perform the steps of inspecting strip 1. Alternatively, the free end 1*a* of strip 1 is brought by carriage 7 between the second pair of pinch rolls 8, 8', which grasp strip 1 to cooperate to the unwinding of strip 1, thus keeping it taut. The gripping member 77 of carriage 7 releases strip 1, and carriage 7 goes back to the start position once strip 1 has been grasped by the second pinch rolls 8, 8'. The strip is unwound until the stretch to be inspected is reached, due to the combined action of mandrel 15 or of the roll unwinding system 13 with the second pair of pinch rolls 8, 8'. According to a possible operating mode of station 100, 110, shears 11 are simultaneously activated with the unwinding of strip 1 in order to divide strip 1 exiting from the pinch rolls 8, 8' into stretches and convey them, for example, towards a collection basket 16. Once the inspection has been finished, the examined part may be rewound on coil 10.

According to another possible operating mode of station 100, 110, once strip 1 has been grasped by the pinch rolls 8, 8' and carriage 7 has returned to the start position, when the stretch of the strip to be examined is reached, the gripping member 77 of carriage 7 grasps strip 1 so that the part to be inspected remains taut between carriage 7 in the start position and the pinch rolls 8, 8'. Shears 6 are activated to cut strip 1, so that strip 1 can be rewound upstream of shears 6 while reversing the rotation direction of mandrel 15 or of the roll unwinding system 13. Once the inspection has been finished, carriage 7 translates at a speed equal to the speed of the pinch rolls 8, 8', while the second shears 11 divide strip 1 into pieces downstream of the pinch rolls 8, 8', conveying them into the collection basket 16.

In the three embodiments in the accompanying FIGS. 1-3-4, the pinch rolls of the first pair 3, 4 and of the second pair 8, 8' are aligned along a plane orthogonal to the sliding direction X of carriage 7.

According to another second embodiment (not shown), the upper roll 3 of the first pair of pinch rolls is displaced towards shears 6 with respect to the lower roll 4, thus creating an offset of said two rolls 3, 4 with respect to a plane orthogonal to the sliding direction X of carriage 7, in order to straighten strip 1 slightly and correct the coil set thereof. According to the need to straighten strip 1, the reciprocal distance along the sliding direction X of the two pinch rolls 3, 4 is adjustable. An oscillatory thrust in the direction orthogonal to the sliding direction X with variable frequency can be optionally applied to the lower roll 4, so as to give strip 1*a* slightly undulated shape, which limits its tendency to wind up.

The inspection station according to the present invention allows to automatically unwind ferrous and non ferrous metal strips regardless of the coil set which characterizes them. By virtue of the mobility of the pinch rolls, in particular that of the first pair 3, 4, and of the possibility of appropriately sizing the gripping member 77 of carriage 7, strips of thickness from 0.1 to 25 mm and with a yield strength in a wide range can be processed;

avoid any contact of the inspection surface S1 of the strip with other members, thus allowing to keep the features of the strip to be inspected unchanged.

The complained drawbacks shown with reference to the known inspection stations are thus obviated.

The invention claimed is:

1. A station for inspecting rolled strips wound in coils, comprising:

a first pair of mutually opposed pinch rolls, adapted to receive a rolled strip from a coil;

a carriage sliding between a first start position, near said first pair of pinch rolls, and a second end position, said sliding carriage comprising a gripping member to grasp said rolled strip coming from said first pair of pinch rolls;

wherein at least one of the rolls of said first pair of pinch rolls is mounted on a swinging arm movable between:

a first raised position near said coil wherein said at least one roll of said first pair of pinch rolls is adapted to intercept a free end of said strip, and a second lowered position near the other roll of said first pair of pinch rolls wherein said free end is gripped between said first pair of pinch rolls.

2. The station according to claim 1, wherein at least one roll of said first pair of pinch rolls is movable in a direction orthogonal to the sliding direction of said carriage.

3. The station according to claim 2, wherein at least one of said rolls of said first pair of pinch rolls oscillates in a direction orthogonal to the sliding direction of said carriage according to a variable frequency.

4. The station according to claim 1, wherein the rolls of said first pair of pinch rolls are aligned along a plane orthogonal to the sliding direction of said carriage.

5. The station according to claim 1, wherein the rolls of said first pair of pinch rolls are offset with respect to a plane orthogonal to the sliding direction of said carriage.

6. The station according to claim 5, wherein the reciprocal distance along the sliding direction of the rolls of said first pair of pinch rolls is adjustable.

7. The station according to claim 1, wherein said station comprises first shears for cutting said strip downstream of said first pair of pinch rolls.

8. The station according to claim 1, wherein said station comprises a second pair of mutually opposed pinch rolls arranged near said second end position to receive said strip from said carriage.

9. The station according to claim 8, wherein said station comprises second shears for cutting said strip downstream of said second pair of pinch rolls.

10. A station for inspecting rolled strips wound in coils, comprising:

a first pair of mutually opposed pinch rolls, adapted to receive a rolled strip from a coil;

a carriage-sliding between a first start position, near said first pair of pinch rolls, and a second end position, said sliding carriage comprising a gripping member to grasp said rolled strip coming from said first pair of pinch rolls;

wherein at least one of the rolls of said first pair of pinch rolls is mounted on a swinging arm movable between:

wherein said station comprises a second pair of mutually opposed pinch rolls arranged near said second end position to receive said strip from said carriage.

11. The station according to claim 10, wherein at least one roll of said first pair of pinch rolls is movable in a direction orthogonal to the sliding direction of said carriage.

12. The station according to claim 11, wherein at least one of said rolls of said first pair of pinch rolls is movable in a direction orthogonal to the sliding direction of said carriage according to a variable frequency oscillatory mode.

13. The station according to claim 10, wherein the rolls of said first pair of pinch rolls are aligned along a plane orthogonal to the sliding direction of said carriage.

14. The station according to claim 10, wherein the rolls of said first pair of pinch rolls are offset with respect to a plane orthogonal to the sliding direction of said carriage.

15. The station according to claim 14, wherein the reciprocal distance along the sliding direction of the rolls of said first pair of pinch rolls is adjustable.

16. The station according to claim 10, wherein at least one of the rolls of said first pair of pinch rolls is mounted on a swinging arm movable between:

a first raised position near said coil wherein said at least one roll of said first pair of pinch rolls is adapted to intercept a free end of said strip, and a second lowered position near the other roll of said first pair of pinch rolls wherein said free end is gripped between said first pair of pinch rolls.

17. The station according to claim 10, wherein said station comprises first shears for cutting said strip downstream of said first pair of pinch rolls.

18. The station according to claim 17, wherein said station comprises second shears for cutting said strip downstream of said second pair of pinch rolls.

* * * * *